US006793695B2

(12) United States Patent
Wilkes et al.

(10) Patent No.: US 6,793,695 B2
(45) Date of Patent: Sep. 21, 2004

(54) ANTI-STATIC LUBRICITY ADDITIVE ULTRA-LOW SULFUR DIESEL FUELS

(75) Inventors: Mark F. Wilkes, Chellaston (GB); David A. Duncan, Ashbourne (GB); Shaun P. Carney, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/220,229

(22) PCT Filed: Mar. 8, 2001

(86) PCT No.: PCT/US01/07612

§ 371 (c)(1),
(2), (4) Date: Aug. 28, 2002

(87) PCT Pub. No.: WO01/88064

PCT Pub. Date: Nov. 22, 2001

(65) Prior Publication Data

US 2004/0118033 A1 Jun. 24, 2004

Related U.S. Application Data

(60) Provisional application No. 60/189,957, filed on Mar. 16, 2000.

(51) Int. Cl.[7] ..... C10L 1/18; C10L 1/22

(52) U.S. Cl. ..... 44/385; 44/388; 44/389; 44/412; 44/432

(58) Field of Search ..... 44/385, 389, 388, 44/412, 432

(56) References Cited

U.S. PATENT DOCUMENTS

| | | | | | |
|---|---|---|---|---|---|
| 4,302,216 | A | | 11/1981 | Spence et al. | 44/71 |
| 4,416,668 | A | | 11/1983 | Thompson | 44/62 |
| 5,197,997 | A | * | 3/1993 | Mozdzen et al. | 44/386 |
| 5,891,203 | A | | 4/1999 | Ball | 44/388 |
| 5,968,211 | A | | 10/1999 | Schilowitz | 44/415 |
| 5,997,593 | A | | 12/1999 | McDonnell et al. | 44/421 |
| 6,001,141 | A | * | 12/1999 | Quigley | 44/330 |
| 6,051,039 | A | * | 4/2000 | Sugimoto | 44/341 |
| 6,129,772 | A | * | 10/2000 | Weers et al. | 44/385 |
| 6,136,050 | A | | 10/2000 | Nakajima et al. | 44/393 |

FOREIGN PATENT DOCUMENTS

| | | | |
|---|---|---|---|
| EP | 0 798 364 | | 10/1997 |
| JP | 02194091 A | * | 7/1990 |
| WO | WO 99/36489 | | 7/1999 |

OTHER PUBLICATIONS

"No Harm Performance and Development of Anti–Static Lubricity Additives for Ultra–Low Sulphur City Diesel Fuels" by Wilkes et al., World Refining Association European Fuels Weeks Fuel Specifications and the Developing Technologies (Taormina, Sicily, Apr. 11, 2000.

JP 08 134476, from Patent Abstracts of Japan, May 28, 1996.

* cited by examiner

*Primary Examiner*—Cephia D. Toomer
(74) *Attorney, Agent, or Firm*—David M. Shold; Michael F. Esposito

(57) ABSTRACT

A fuel composition exhibiting improved anti-static properties, comprises a liquid fuel which contains less than 500 parts per million by weight sulfur; 0.001 to 1 ppm of a hydrecarbyl monoamine or hydrocarbyl-substituted poly (alkylenieamine); and 10 to 500 ppm of at least one fatty acid containing 8 to 24 carbon atoms, or an ester thereof.

22 Claims, No Drawings

ANTI-STATIC LUBRICITY ADDITIVE ULTRA-LOW SULFUR DIESEL FUELS

This application claims priority from U.S. Provisional Application No. 60/189,957, filed Mar. 16, 2000.

BACKGROUND OF THE INVENTION

The present invention relates to improved low-sulfur fuel compositions which exhibit reduced static and good lubricity.

As a consequence of the refinery processes employed to reduce diesel sulfur and aromatics content, the majority of ultra-low sulfur Diesel (50 ppm w/w sulfur max.), fuels marketed today require treatment with an additive to restore lubricity. A further consequence of the removal of sulfur from the fuel is a reduction in its electrical conductivity. The more highly insulating nature of the ultra-low sulfur fuel presents additional risk to refiners, oil companies and consumers alike, due to the potential build-up of high static charges. Static charging can occur during pumping operations. In such operations, the flow of low conductivity liquid through pipes and filters, combined with the disintegration of a liquid column and splashing during high speed tank loading can result in static charging. Such static charging can result in spark electrical discharge, with catastrophic potential in highly flammable environments.

The dissipation of static charge by, for instance, the addition of a conductivity-enhancing additive to the fuel is becoming an increasingly important issue as diesel sulfur levels are progressively reduced. Field experience has shown that the conductivity additive should provide enhanced conductivity within the fuel to avoid the build-up of static charge and should have no undesirable side effects. Such side effects could include: degrading the properties of the base fuel; interacting with crankcase lubricating oils; and reducing the performance benefit of lubricity or other fuel additives.

The global legislative drive to reduce automotive emissions has resulted in a widespread reduction in diesel fuel sulfur levels. The sulfur present in diesel fuels has been demonstrated to have several adverse environmental consequences.

In order to meet emissions and fuel efficiency goals, automotive original equipment manufacturers are investigating the use of NOx traps, particulate traps and direct injection technologies. Such trap and catalyst systems tend to be intolerant to sulfur, thus a further category for diesel fuel has been introduced for markets with further advanced requirements for emission control. This new category of diesel is used to define the cleanest burning fuels required to enable sophisticated after-treatment technologies to be used. The new "Category 4 diesel fuel" specifies "sulfur-free" diesel (5–10 ppm maximum) (Reference World-Wide Fuel Charter, April 2000, Issued by ACEA, Alliance of Automobile Manufacturers, EMA and JAMA). This is the required specification to ensure compliance with emissions requirements over the full useful life of this latest technological generation of vehicles. Low sulfur and ultra-low sulfur fuels are also becoming increasingly necessary for conventional diesel engines, as governments introduce further legislation for the reduction in particulate matter.

A primary consequence of the removal of sulfur from fuels is the removal of much of the natural lubricating properties of the fuel. As a secondary consequence, the levels of conducting species such as aromatics and heteroatoms is reduced during hydrodesulfurization processing at the refinery. Generally, as the concentration of conducting species in a fuel increases, so do both the electrical conductivity and the static charging potential. This continues until a maximum potential for charging is reached. As conductivity continues to rise beyond this critical value, the charging effect is ameliorated by dissipation through the fuel and the spark discharge tendency is reduced. Static charging is most significant therefore in fuels with conductivity around or below the aforementioned critical value.

The potentially catastrophic problems associated with static charging in fuel pumping applications were first addressed in the jet-fuel industry, in which the necessary high pumping rates of the low sulfur (~400 ppm w/w UK average) resulted in inevitable static charging. The static-charging problem is such that the standard specifications for jet fuels include the addition of an additive to increase their conductivity. The treatment is usually with an industry standard specified additive at the rate of ~2 ppm w/w. The minimum conductivity requirement for jet kerosene is generally quoted as 50 picosiemens $m^{-1}$.

In diesel applications, the presence of high concentrations of sulfur containing molecules (>500 ppm) has been sufficient to give significant intrinsic conductivity, such that static charging problems have not been a problem. However, as sulfur levels in diesel are reduced, the risk of static charging during pumping operations has increased significantly. This has resulted in several reports of road tanker explosions in Europe following the introduction of Ultra-Low Sulfur Diesel (ULSD), despite the use of grounding leads. These incidents were specifically attributed to static charge induced spark ignition of fuel vapor, during fuel transfer operations.

Increasingly, the addition of lubricity additives to diesel is effected at the refinery. It is therefore desirable to address the lubricity and conductivity problems associated with ULSD with a single additive package.

The oil and additive industries have developed a wide range of tests to evaluate the no-harm performance of additive packages and components. The present invention provides a new lubricity 1 anti-static additive package suitable for meeting the requirements of ULSD Fuel.

The additive packages of the present invention provide protection against the build-up of static charge without significant undesirable effects on the fuel or lubricity additive performance. The possibility of interaction between anti-static additives and typical lubricity packages, and the resulting potential influence over product performance and ultimately fuel quality, is minimized.

Various lubricity additives are known in the art. U.S. Pat. No. 5,833,722, Davies et al., Nov. 10, 1998, discloses enhancing the lubricity of low sulphur fuels by incorporation of a lubricity enhancing additive, such as a carboxylic acid ester, in combination with a nitrogen compound carrying one or more substituents of the formula $>NR^{13}$ where $R^{13}$ represents a hydrocarbyl group containing 8 to 40 carbon atoms. European Patent Application 798 364, Oct. 1, 1997, discloses a diesel fuel additive comprising a salt of a carboxylic acid and an aliphatic amine, or an amide obtained by dehydration-condensation thereof. The additive reduces the amount of deposits and improves lubricity of the fuel. It is also said to impart anti-wear property to diesel fuel of low sulfur content.

SUMMARY OF THE INVENTION

The present invention provides a fuel composition exhibiting improved anti-static properties comprising:

a liquid fuel which contains less than 500 parts per million by weight sulfur;

0.001 to 1 part per million by weight of at least one hydrocarbyl monoamine or N-hydrocarbyl-substituted poly(alkyleneamine); and 20 to 500 parts per million by weight of at least one fatty acid containing 8 to 24 carbon atoms or an ester thereof with an alcohol or polyol of up to 8 carbon atoms.

DETAILED DESCRIPTION OF THE INVENTION

Various preferred features and embodiments will be described below by way of non-limiting illustration.

The fuel component of the present invention is a liquid fuel such as a hydrocarbon fuel, although alcohol-containing fuels and natural ester oil fuels are also encompassed. The fuel is preferably a diesel fuel. The diesel fuels that are useful with this invention can be any diesel fuel. The diesel fuel typically constitutes the major proportion (at least about 90% by weight; and in one embodiment at least about 95% by weight) of the diesel fuel composition of the present invention. The diesel fuel includes those that are defined by ASTM Specification D396. Any fuel having a boiling range and viscosity suitable for use in a diesel-type engine can be used. These fuels typically have a 90% point distillation temperature in the range of about 300° C. to about 390° C., and in one embodiment about 330° C. to about 350° C. The viscosity of diesel fuels typically ranges from about 1.3 to about 24 centistokes at 40° C. The diesel fuels can be classified as any of Grade Nos. 1-D, 2-D or 4-D as specified in ASTM D 975 entitled "Standard Specification for Diesel Fuel Oils". These diesel fuels can contain alcohols and esters.

The fuels of the present invention are low sulfur or sulfur-free fuels. These contain less than 500 or 400 parts per million sulfur, preferably less than 200 or 100 parts per million. The preferred ultra-low sulfur fuels contain less than 70 ppm, 50 ppm, or 40 ppm sulfur, and more preferably less than 30 or 20 parts per million. So-called sulfur-free fuels contain less than 10 or 5 ppm or even 1 ppm sulfur. The sulfur content can be determined by the test method specified in ASTM D 2622–87 entitled "Standard Test Method for Sulfur in Petroleum Products by X-Ray Spectrometry".

The low sulfur diesel fuels of this invention include those obtained by such methods as the hydrodesulfurization of the diesel fuel fraction (which is obtained by the atmospheric distillation of crude oil) at a high reaction temperature, under a high hydrogen partial pressure, or using a highly active hydrodesulfurization catalyst, but the desulfurization method is not specifically limited. In addition, tile low sulfur fuels of this invention include fuels blended from low sulfur components, "bio-diesel" fuels and fuels derived from various gas-to-liquid processes.

Conductivity testing of fuel specimens is completed according to ASTM 2624 using an Emceedm Digital Conductivity Meter (Model 1152), which has a range 0–2000 picosiemens $m^{-1}$ ($pSm^{-1}$). The instrument is self calibrating and zeroing and is used in accordance with the user manual and experimental method. All conductivity values are measured within the temperature range 17.3 to 20.8° C. All conductivity measurements are in picosiemens $m^{1}$, also known as CU or Conductivity Units.

The variations in conductivity in response to the concentration and type of anti-static component (ASC), is evaluated in two ways. Initial experiments are conducted in which performance of the individual components alone is tested in additive free ULSD. These tests are completed in the absence of the lubricity additives of the present invention, in order to assess the primary function and performance of the test components. The results are shown in Table 1.

In Table 1, components 1 and 2 are commercial anti-static additive compositions, available as Tolad™ 3511 and Tolad™ 3512, respectively. Component 1 is believed to be a formulation of 1–5% N-alkylpropylenediamine along with 1–5% ethanediol, 10–30% 2-butoxyethanol and 30–60% light aromatic solvent naphtha. Component 2 is believed to be a formulation of 1–5% Cocoalkyl amine along with 1–5% ethanediol, 5–10% methyl isobutyl ketone, 10–30% 2-butoxyethanol and 30–60% Ally Benzenes ($C_9$–$C_{10}$).

TABLE 1

| | conductivity in picosiemens $m^{-1}$ | | | |
|---|---|---|---|---|
| Antistatic Formulation | 0 ppm | 1 ppm | 2 ppm | 3 ppm |
| #1 | 6.5 | 33 | 45 | 65 |
| #2 | 6.5 | 27 | 53 | 67 |

It is observed that the conductivity of the ULSD falls significantly below that required for jet-fuel applications (50 picosiemens $m^{-1}$), and as such could potentially give rise to static charge dissipation problems during transfer. Each ASC does eventually increase the fuel conductivity to acceptable levels. Further tests are conducted in which the commercial antistatic components 1, and 2 are used in conjunction with the lubricity packages (LP) of the present invention in ULSD. The lubricity packages are selected to represent those which provide a variety of performance levels in the diesel HFRR lubricity test (described below).

The lubricity package will supply to the formulation 10 to 500 parts per million by weight, preferably 20 to 300 ppm, and more preferably 25 to 210 ppm, of at least one fatty acid containing 8 to 24 carbon atoms or and ester thereof with an alcohol or polyol of up to 8 carbon atoms. The fatty acid can be a mixture of fatty acids, and preferably contains on average 16 to 20 carbon atoms, that is, about 18 carbon atoms. The fatty acid or acids can be linear or branched, and saturated or unsaturated acids. An example of a suitable commercial acid material is tall oil fatty acid, which is believed to be a mixture of predominantly oleic and linoleic acids. Examples of esters include methyl and ethyl esters and glycerol esters such as glycerol monooleate and dioleate.

Three lubricity packages are presented as representative.

LP-A is a composition of greater than 60 percent by weight Tall Oil Fatty Acid, in combination with solvent, corrosion inhibitor, and demulsifier.

LP-B is a composition of 15–40% Tall Oil Fatty Acid, in combination with antioxidant, corrosion inhibitor, and solvents.

LP-C is another composition of 15–40% Tall Oil Fatty Acid, in combination with antioxidant, corrosion inhibitor, dispersant, demulsifier, antifoam agent, and solvents.

The results of testing of compositions containing these lubricity packages (presented as amount of tall oil fatty acid ["TOFA"]) is reported in Table 2.

TABLE 2

| Conductivity (in $pSm^{-1}$) of ULSD in the presence of combinations of lubricity packages and antistatic compositions: | | | |
|---|---|---|---|
| amt. of Antistatic Formulation: | 0 ppm | 1 ppm | 2 ppm |
| LP-A (204 ppm TOFA) plus: | | | |
| ASC-1 | 10 | 12 | 19 |
| ASC-2 | 10 | 13 | 21 |
| LP-B (62 ppm TOFA) plus: | | | |
| ASC-1 | 18 | 85 | 148 |
| ASC-2 | 18 | 89 | 153 |
| LP-C (62 ppm TOFA) plus: | | | |
| ASC-1 | 55 | 105 | 174 |
| ASC-2 | 55 | 120 | 186 |

LP-A has little influence on the conductivity of the ULSD in the absence of an antistatic composition. The response to each ASC is similar to that observed in the initial tests on ULSD alone, but is moderated in each case.

In the case of LP-B, the conductivity of the ULSD in the absence of an antistatic composition is slightly increased on incorporation of the LP. The response of the resulting additives ULSD to the anti-static additives is in contrast to that observed for the same ULSD when treated with LP-A. In the presence of LP-B, ASC-1 and ASC-2 are effective in increasing the conductivity of the ULSD at the given treat rates. Comparison between the conductivity of the ULSD and the lLSD treated with LP-B, when both are treated with ASC-1 and ASC-2 at 2 ppm shows that the combination of LP-B and the anti-static components have a synergistic effect in increasing the conductivity.

The antistatic composition generally comprises at least one hydrocarbyl monoamine or N-hydrocarbyl-substituted poly(alkyleneamine). The hydrocarbyl substituent is preferably an alkyl group, which can be linear, branched, or cyclic. The hydrocarbyl,substituent contains sufficient carbon atoms to render the amine compound soluble in suitable hydrocarbon solvents and diesel fuel. It typically contains 5 to 20, or preferably 8 to 18 carbon atoms. The poly (alkylenearrine) can bear one or more such hydrocarbyl substituents, up to a maximum of the number of replaceable hydrogen atoms which would otherwise be present in the molecule. Preferably there is 1 such substituent.

The hydrocarbon group can also comprise mixtures of alkyl groups characteristic of naturally occurring materials. The alkyl groups can be linear, branched or cyclic and can be saturated or unsatrated. In one embodiment the bydrocarbyl amine is cocoamine, which is believed to be a mixture of $C_8$ to $C_{18}$ amites, including in particular $C_{14}$ to $C_{18}$ amines.

The poly(alkyleneamine) which bears the hydrocarbyl substituent can contain 2 to 6 nitrogen atoms. It is preferably an alkylenediamine, more preferably a propylenediamine such as 1,3-propylenediamine or 1,2-propylenediamine.

The effective amount of the active antistatic chemical provided in a given formulation will depend both on the amount of antistatic composition added and the amount of active chemical in that composition. In the present invention the amount of antistatic composition is most generally 0.1 to 5 parts per million by weight, preferably 0.5 to 4 parts per million, more preferably 1 to 3 parts per million. Given that the amount of active components in ASC-1 and ASC-2 is 1 to 5 percent this will correspond to an actual treat rate of 0.001 to 0.25 or even 1 part per million in a broad embodiment. Correspondingly more preferred embodiments would reflect treat rates of the active component of 0.005 to 0.2 ppm, 0.01 to 0.15 ppm, 0.02 to 0.1 ppm, and 0.04 to 0.08 ppm.

The effective amount of the lubricity additive will likewise depend both on the amount of the additive composition added and the amount of the active chemical in that composition. In the present invention the amount of the lubricity additive, expressed as the amount of active component (such as tall oil fatty acid) is most generally 10 500 parts per million by weight, preferably 20 or 40 to 300 ppm, 50 to 250 ppm, or 60 to 210 ppm.

The present invention also encompasses the antistatic and lubricity additives in a concentrate form, which can be added to a liquid fuel to obtain the above-described mixtures. Concentrates are well known and generally comprise the active chemical components in a diluent or solvent in a concentrate-forming amount. The diluent for a fuel application is normally a combustible solvent. Its amount will comprise the balance of the concentrate after accounting for the antistatic formulation, the lubricity additive formulations, and any other conventional components which may be present in the concentrate. Typically a concentrate will be added to a fuel at an amount of roughly 0.1 percent by weight or by volume; accordingly, the concentration of the components within the concentrate may be approximately three orders of magnitude higher than in the final fuel composition. That is, the amount of the hydrocarbyl monoamine or N-hydrocarbyl-substituted poly (alkyleneamine) may be 1 to 1000 parts per million by weight, and the amount of the fatty acid or ester may be 1 to 50 percent by weight of the concentrate.

Most diesel fuels which require treatment with an anti-static additive will also need to be treated with a lubricity additive. A primary assessment of anti-static additives must therefore be to investigate the effect of the anti-static additive on the performance of typical lubricity packages. In this testing, the effect of the anti-static components 1 and 2 on the performance of each of the three lubricity packages A, B and C is assessed.

HFRR lubricity testing is conducted according-to test procedure CEC RF-06-A-96, using the same additive free ULSD fuel as used in the conductivity testing. The anti-static formulations are tested at a concentration of 2 ppm top treat rate. The amount of the lubricity package is the same as in the testing for Table 2. The results of this testing are reported in Table 3 as corrected wear scar diameters (WSD) in $\mu$m. The HFRR test variance is approximately ±30$\mu$m. The European standard for diesel fuel, EN590, specifies a maximum WSD of 460 $\mu$m.

TABLE 3

| | Wear Scar Diameters in $\mu$m | | | |
|---|---|---|---|---|
| | None | LP-A | LP-B | LP-C |
| None | 607.2 | 255.2 | 410.5 | 475.0 |
| ASC-1 | — | 289.4 | 406.6 | 428.0 |
| ASC-2 | — | 379.0 | 428.6 | 448.3 |

The addition of each LP results in significant improvements in the anti-wear performance of the ULSD fuel, which does not meet the EN590 standard without additive treatment.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the bydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A fuel composition exhibiting improved anti-static properties, comprising:

(a) a liquid fuel which contains less than about 500 parts per million by weight sulfur;

(b) about 0.001 to about 1 part per million by weight of at least one hydrocarbyl monoamine or N-hydrocarbyl-substituted poly(alkyleneamine); and (c) about 10 to about 500 parts per million by weight of at least one fatty acid containing about 8 to about 24 carbon atoms or an ester thereof with an alcohol or polyol of up to about 8 carbon atoms.

2. The composition of claim 1, wherein the fuel is a diesel fuel.

3. The composition of claim 1, wherein the fuel contains less than about 50 parts per million sulfur.

4. The composition of claim 1, wherein the fuel contains less than about 10 parts per million sulfur.

5. The composition of claim 1, wherein the material of (b) is a hydrocarbyl monoamine.

6. The composition of claim 5, wherein the hydrocarbyl monoamine comprises mixed $C_8$ to $C_{18}$ alkyl amines.

7. The composition of claim 5, wherein the hydrocarbyl monoamine is cocoalkyl amine.

8. The composition of claim 1, wherein the material of (b) is an N-hydrocarbyl-substituted poly(alkyleneamine).

9. The composition of claim 8, wherein the N-hydrocarbyl-substituted poly(alkyleneamine) is an alkyl-substituted alkylenediamine.

10. The composition of claim 8, wherein the N-hydrocarbyl-substituted poly(alkyleneamine) is an alkyl-substituted propylenediamine.

11. The composition of claim 9, wherein the alkyl group contains about 5 to about 20 carbon atoms.

12. The composition of claim 9, wherein the alkyl group contains about 8 to about 18 carbon atoms.

13. The composition of claim 1, wherein the amount of component (b) is about 0.01 to about 0.15 parts per million by weight.

14. The composition of claim 1, wherein the fatty acid of (c) contains about 14 to about 20 carbon atoms.

15. The composition of claim 1, wherein the fatty acid comprises an unsaturated acid.

16. The composition of claim 1, wherein the fatty acid comprises a mixture of oleic acid and linoleic acid.

17. The composition of claim 1, wherein the fatty acid comprises tall oil fatty acids.

18. The composition of claim 1, wherein the fatty acid or ester thereof of (c) is a fatty acid.

19. The composition of claim 1, wherein the amount of component (c) is 20 to 300 parts per million by weight.

20. A composition prepared by admixing the components of claim 1.

21. A concentrate comprising a concentrate forming amount of a combustible solvent and (b) about 1 to about 1000 parts per million by weight of at least one hydrocarbyl monoamine or N-hydrocarbyl-substituted poly(alkyleneamine); and (c) about 1 to about 50 percent by weight of at least one fatty acid containing about 8 to about 24 carbon atoms or an ester thereof with an alcohol or polyol of up to about 8 carbon atoms.

22. The composition of claim 1 wherein the amount of component (b) is about 0.01 to about 0.15 parts per million by weight and the amount of component (c) is about 20 to about 300 parts per million by weight.

* * * * *